United States Patent [19]

Hayashi

[11] 4,123,903

[45] Nov. 7, 1978

[54] DECELERATION CONTROL SYSTEM

[75] Inventor: Yoshimasa Hayashi, Yokohama, Japan

[73] Assignee: Nissan Motor Company, Ltd., Japan

[21] Appl. No.: 755,032

[22] Filed: Dec. 28, 1976

[30] Foreign Application Priority Data

Dec. 29, 1975 [JP] Japan ..... 50/156011

[51] Int. Cl.[2] ..... F02B 75/10; F02D 31/00

[52] U.S. Cl. ..... 60/277; 60/285; 123/97 B; 123/124 R

[58] Field of Search ..... 60/285, 277; 123/97 B, 123/124 R, 124 A, 124 B, 119 D

[56] References Cited

U.S. PATENT DOCUMENTS

| | | | |
|---|---|---|---|
| 3,799,134 | 3/1974 | Griese | 60/285 |
| 3,818,701 | 6/1974 | Foster | 60/285 |
| 3,896,913 | 7/1975 | Maruoka | 123/117 R |
| 4,008,696 | 2/1977 | Hisatomi | 123/97 B |
| 4,051,823 | 10/1977 | Mogi | 123/117 A |

*Primary Examiner*—Douglas Hart

[57] ABSTRACT

An additional passageway is prevented from supplying additional air into an engine intake passageway downstream of a throttle valve and alternatively the throttle valve is prevented from being opened a predetermined amount when the temperature of a catalyst of an engine catalytic converter is below an allowable limit during deceleration of the engine.

8 Claims, 2 Drawing Figures

DECELERATION CONTROL SYSTEM

BACKGROUND OF THE INVENTION

1. Field of the Invention

The present invention relates generally to a deceleration control system for supplying additional air or an additional air-fuel mixture to an engine during deceleration of the engine and particularly to a deceleration control system of this type which is rendered operative to supply the additional air or the additional air fuel mixture to the engine only when the temperature of a catalyst of a catalytic converter is undesirably increased above an allowable limit.

2. Description of the Prior Art

As is well known in the art, when an engine is in its decelerating condition, since a throttle valve is fully closed notwithstanding that the engine speed is high, the vacuum in an intake passageway downstream of the throttle valve is extremely increased, that is, the amount of air drawn into the engine is extremely insufficient. As a result, the combustion of an air-fuel mixture in the engine is deteriorated and, in an extreme instance, becomes impossible. This results in the production of engine exhaust gas containing a large quantity of burnable components such as hydrocarbons (HC).

On the other hand, the engine is provided in its exhaust system with a catalytic coverter which efficiently oxidizes the burnable component contained in the engine exhaust gas in the presence of secondary air fed into the engine exhaust gas by a secondary air supply device employing an air pump or a vacuum induced in an engine exhaust gas passageway. In an engine employing a lean air-fuel mixture, excessive oxygen contained in engine exhaust gas is used for oxidization of the burnable component of the engine exhaust gas in a catalytic converter and can be substituted for a secondary air supply device.

However, when the engine misfires to discharge exhaust gas containing a large quantity of burnable component such as hydrocarbon with secondary air fed into the engine exhaust gas or a lean air-fuel mixture fed into the engine, all the burnable component in the engine exhaust gas is often burned at a stretch in the catalytic converter. In such a condition, the temperature of the catalyst in the catalytic converter is abnormally increased which results in deterioration of the catalyst and could also induce burning of the catalyst in an extreme case.

As a solution to such a problem, an engine is provided with a deceleration control system comprising an additional passageway bypassing a throttle valve and a control valve for opening the additional passageway during deceleration of the engine, or means for opening the throttle valve a small amount during deceleration of the engine. The deceleration control system serves to supply the engine with additional air or an additional air-fuel mixture to thereby compensate deficiency of air drawn into the engine and prevent a vacuum in an intake passageway downstream of the throttle valve from being extremely increased.

However, a conventional deceleration control system has been continually rendered operative during deceleration of an engine to supply the engine with additional air or an additional air-fuel mixture even when the temperature of a catalyst of a catalytic converter is below an allowable limit below which there is no risk of the catalyst being deteriorated by heat. This results in an increase in fuel consumption and a lowering of engine braking effect or performance.

SUMMARY OF THE INVENTION

It is, therefore, an object of the invention to provide a deceleration control system which is rendered operative to supply additional air or an additional air-fuel mixture to an engine to prevent deterioration of combustion in the engine and of a catalyst in a catalytic converter only when the temperature of a catalyst of a catalytic converter is undesirably increased above an allowable limit during deceleration of the engine and inoperative to inhibit supply of the additional air or the additional air-fuel mixture to the engine to reduce fuel consumption and to increase engine brake performance when the temperature of the catalyst of the catayltic converter is below the allowable limit during deceleration of the engine. The deceleration control system comprises a cancel device for rendering a vacuum control device which is operative to supply the additional air-fuel mixture to the engine during deceleration of the engine inoperative when the temperature of the catalyst is below the allowable limit. The cancel device comprises a control valve operable in response to a temperture of the catalyst below the allowable limit to admit atmospheric air into a fluid chamber located on a side of a flexible diaphragm for opening a vacuum control valve in an additional passageway or an engine throttle valve in reponse to an increased vacuum in the fluid chamber during deceleration of the engine.

BRIEF DESCRIPTION OF THE DRAWINGS

These and other objects and advantages of the invention will become more apparent from the following detailed description taken in connection with the accompanying drawings in which.

DESCRIPTION OF THE PREFERRED EMBODIMENTS

Figure 1:
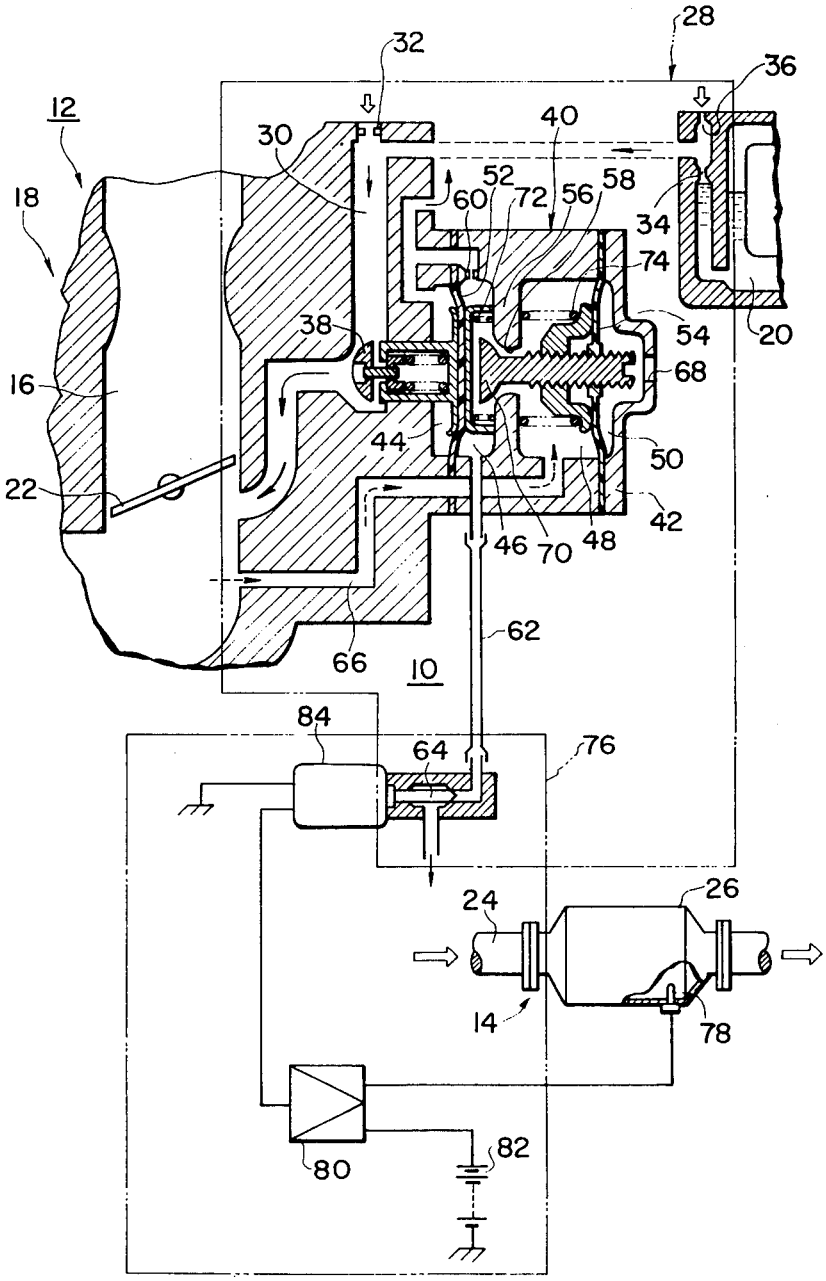
FIG. 1 is a schematic cross sectional view of a first preferred embodiment of a deceleration control system according to the invention.

Referring to FIG. 1 of the drawings, there is shown a first preferred embodiment of a deceleration control system according to the invention. The deceleration control system, generally designated by the reference numberal 10, is combined with intake and exhaust systems 12 and 14 of an internal combustion engine (not shown).

The intake system 12 is shown to include an intake passageway 16 for providing communication between the atmosphere and the engine to conduct atmospheric air thereinto, and a carburetor 18 including a part of the intake passageway 16 and a float chamber 20. The intake passageway 16 has a throttle valve 22 rotatably mounted therein. Although the carburetor 18 includes a main system providing an air-fuel mixture for operations at speeds above low speeds and a slow system providing an air-fuel mixture for operations at low speeds and idling, the illustration of the main and slow systems is omitted for the purpose of simplicity.

The exhaust system 14 is shown to include an exhaust gas passageway 24 for providing communication between the engine and the atmosphere to conduct exhaust gas of the engine. An exhaust gas purifying device 26 is located in the exhaust gas passageway 24 and is in this embodiment a catalytic converter which catalytically oxidizes burnable components such as hydrocarbons (HC) and carbon monoxide (CO) contained in the engine exhaust gas.

The deceleration control system 10 comprises a vacuum control device 28 for feeding into the intake passageway 16 additional air or an additional air-fuel mixture for preventing the vacuum in the intake passageway 16 from being undesirably or excessively increased during deceleration of the engine. The vacuum control device 28 comprises an additional passageway 30 communicating at one end with the atmosphere through an air bleed 32 and opening at the other end into the intake passageway 16 downstream of the throttle valve 22. The additional passageway 30 may open into the intake passageway 16 upstream of the throttle valve 22 or an engine air cleaner (not shown) on a clean side thereof to form a bypass passageway around the throttle valve 22. The additional passageway 30 also communicates through an orifice 34 with the float chamber 20 and with an air bleed 36 which is formed at the float chamber 20 and communicates with the atmosphere. The diameters or cross sectional areas of the air bleeds 32 and 36 and the orifice 34 are so determined that an additional air-fuel mixture having a proper air-fuel ratio and a proper quantity is formed in the additional passageway 30 from fuel drawn thereinto through and metered by the orifice 34 and air drawn thereinto through and metered by the air bleeds 32 and 36. A vacuum control valve 38 is disposed in the additional passageway 30 to open and close it and includes means 40 for operating the control valve 38. The operating means 40 comprises a diaphragm assembly comprising a housing 42 having therein first, second, third and fourth fluid chambers 44, 46, 48 and 50. First and second flexible diaphragms 52 and 54 are movably located in the housing 42. The diaphragm 52 separates the chambers 44 and 46 from each other, while the diaphragm 54 separates the chambers 48 and 50 from each other. A partition member 56 is provided to separate the chambers 46 and 48 from each other and is formed therethrough with an aperture 58 providing communication between the chambers 46 and 48. The chamber 44 communicates with the engine air cleaner so that the pressure in the chamber 44 is about atmospheric pressure. The chamber 46 communicates with the atmosphere through an orifice 60 and communicates with the engine air cleaner or opens into the atmosphere through a passage 62 and a control valve 64 which is provided to open and close the passage 62. The chamber 48 communicates with the intake passageway 16 downstream of the throttle valve 22 through a passage 66 so that it is fed with a vacuum in the intake passageway 16 downstream of the throttle valve 22. The chamber 50 communicates with the atmosphere through an aperture 68. The diaphragm 52 is operatively connected to the vacuum control valve 38. The diaphragm 54 is operatively connected to a control valve 70 which is provided to open and close the aperture 58 of the partition member 56. A spring 72 is provided to urge the diaphragm 52 in a direction opposed by a pressure in the chamber 44. A spring 74 is provided to urge the diaphragm 54 and the control valve 70 in a direction opposed by the atmospheric pressure in the chamber 50.

The deceleration control system 10 further comprises a cancel device 76 for rendering the vacuum control device 28 ineffective to make it impossible for the control device 28 to admit the additional air-fuel mixture into the intake passageway 16 through the additional passgeway 30 when the temperature of the catalytic converter 26 is lower than an allowable limit during deceleration of the engine. The cancel device 76 comprises a sensor 78 located in the catalytic converter 26 to sense the temperature of the catalyst (not shown) in the catalytic converter 26. Alternatively, the sensor 78 may be located outside the catalytic converter 26 such as within the exhaust gas passageway 24 downstream of the catalytic converter 26 or in a floor portion of a vehicle (not shown) which portion is adjacent to the catalytic converter 26 to sense a temperature which is representative of a function of or is in mutual relationship with the temperature of the catalyst. The sensor 78 includes means to generate an electric output signal having a value representative of the sensed temperature and is electrically connected to a modulator 80 to feed the output signal thereto. The modulator 80 is electrically connected to an electric power source 82 and to means 84 for electromagnetically operating the control valve 64. The modulator 80 includes means to compare the value of the output signal of the sensor 78 with a reference value at which the temperature of the catalyst of the catalytic converter 26 is equal to an allowable limit temperature such as, for example, 800° C. below which there is no risk of the catalyst being degraded by heat and above which there is the risk of the catalyst being not only degraded but also damaged or burned by heat. The modulator 80 includes means to generate a first electric command signal in response to which the operating means 84 is, for example, energized to cause the control valve 64 to open the passage 62 when the catalyst of the catalytic converter 26 has a normal temperature below the allowable limit temperature and a second electric command signal in response to which the operating means 84 is, for example, deenergized to cause the control valve 64 to close the passage 62 when the catalyst of the catalytic converter 26 has an abnormal temperature above the allowable limit temperature.

The deceleration control system 10 thus far described is operated as follows:

When the engine is decelerating to increase the vacuum in the intake passageway 16 downstream of the throttle valve 22 above a predetermined value, the diaphragm 54 is moved in response to an increased vacuum in the chamber 48 into a position in which the control valve 70 opens the aperture 58. As a result, the vacuum pressure in the chamber 48 is admitted into the chamber 46.

At this state, when the sensor 78 senses that temperature of the catalyst of the catalytic converter 26 is below the predetermined limit, the control valve 64 opens the passage 62 in response to the first command signal of the modulator 80 to admit atmospheric air into the chamber 46. This renders it impossible for the vacuum in the chamber 48 to be effective in the chamber 46 and allows the spring 72 to move the diaphragm 52 into a position in which the control valve 38 closes the additional passageway 30. As a result, the deceleration control device 10 has rendered it impossible to feed an additional air-fuel mixture to the intake passageway 16.

On the contrary, when the sensor 78 senses that the temperature of the catalyst of the catalytic converter 26 is above the predetermined limit, the control valve 64 closes the passages 62 in response to the second command signal of the modulator 80 to inhibit admission of atmospheric air into the chamber 46. This makes the vacuum admitted from the chamber 48 into the chamber 46 effective to allow the pressure in the chamber 44 to move in opposition to the force of the spring 72 the diaphragm 52 into a position in which the vacuum control valve 38 opens the additional passageway 30. As a result, an additional air-fuel mixture is drawn from the additional passageway 30 into the intake pasageway 16 to prevent the intake suction of the engine from being excessively or abnormally increased. Accordingly, the combustion of an air-fuel mixture in the engine is prevented from being deteriorated due to deficiency of air to prevent the production of burnable components such as hydrocarbons and carbon monoxide from being abnormally increased. Consequently, the catalytic converter 26 satisfactorily oxidizes the burnable components in the engine exhaust gas.

Figure 2:
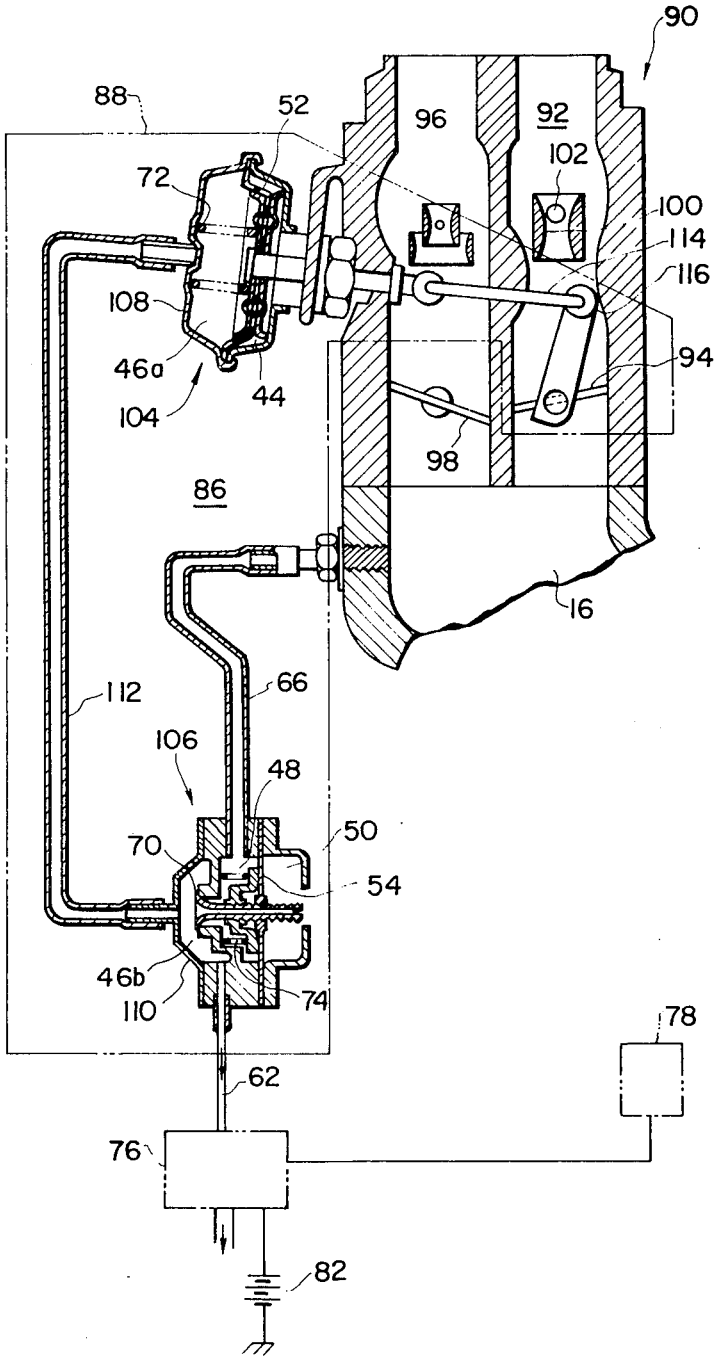
FIG. 2 is a schematic cross sectional view of a second preferred embodiment of a deceleration control system according to the invention.

Referring to FIG. 2 of the drawings, there is shown a second preferred embodiment of a deceleration control system according to the invention. The deceleration control system, generally designated by the reference numeral 86, is characterized in that a vacuum control device 88 serves to increase the amount of an air-fuel mixture drawn into the engine by opening the throttle valve 22 a small amount or by increasing the degree of opening of the throttle valve 22 a small amount during deceleration of an engine (not shown). In FIG. 2, like component elements are designated by the same reference numerals as those used in FIG. 1. In this embodiment, the deceleration control system 86 is combined with a conventional twin barrel carburetor 90 including a primary intake passageway 92 having a primary throttle valve 94 rotatably mounted therein and a secondary intake passageway 96 having a secondary throttle valve 98 rotatably mounted therein. Although the primary intake passageway 92 includes a main system and a slow system having fuel passage means opening into the intake passageway 92 adjacent to the throttle valve 94 in its fully closed position, with respect to the main system only a venturi 100 and a main fuel nozzle 102 are shown and the illustration of the slow system is omitted, for purpose of simplicity.

The vacuum control device 88 comprises a diaphragm assembly for operating the primary throttle valve 94. The diaphragm assembly 83 comprises first and second diaphragm units 104 and 106 having housings 108 and 110, respectively. The diaphragm units 104 and 106 are equivalent respectively to two divisional diaphragm units of the diaphragm assembly 40 shown in FIG. 1 into which the diaphragm assembly 40 is divided in the chamber 46. The housing 108 has the chamber 44 and a chamber **46*a* while the housing 110 has a chamber 46*b* and the chambers 48 and 50. In this embodiment, the passage 62 opens into the chamber 46*b*. A passage 112 provides communication between the chambers 46*a* and 46*b*. The diaphragm 52 of the diaphragm unit 104 is operatively connected to the throttle valve 94 through a linkage mechanism such as a link 114 and a throttle lever 116, in lieu of the diaphragm 52 of the diaphragm assembly 40 shown in FIG. 1 being operatively connected to the vacuum control valve 38**.

When the temperature of the catalyst of the catalytic converter 26 is below the predetermined value during deceleration of the engine, the control valve 64 is opened to provide communication between the chamber **46*b* and the atmosphere through the passage 62 to admit atmospheric air into the chambers 46*a* and 46*b* as mentioned hereinbefore in connection with FIG. 1 As a result, the diaphragm 52 is moved by the force of the spring 72 into a position in which the throttle valve 94** is fully closed or is in a condition near to its fully closed condition.

On the contrary, when the temperature of the catalyst of the catalytic converter 26 is above the predetermined value during deceleration of the engine, the control valve 64 is closed to obstruct communication between the chamber **46*b* and the atmosphere through the passage 62 to inhibit admission of atmospheric air into the chambers 46*a* and 46*b* as mentioned above in connection with FIG. 1. As a result, the diaphragm 52 is moved, in response to the engine suction admitted into the chamber 46*a* through the passage 66, the chambers 48 and 46*b* and the passge 112, into a position in which the throttle valve 94 is opened a small amount. Accordingly, the flow of air drawn into the intake passageway 92 downstream of the throttle valve 94 is increased to prevent the vacuum in the intake passage 16** from being undesirably increased.

It will be thus appreciated that the invention provides a deceleration control system by which an additional passageway feeds additional air into an engine intake passageway downstream of a throttle valve and alternatively the throttle valve is opened a predetermined amount only when the temperature of a catalyst of an engine catalytic converter is increased above an allowable limit during deceleration of the engine so that the combustion of an air-fuel mixture in the engine is prevented from being wastefully improved to reduce fuel consumption and to increase engine braking performance and the catalytic converter is effectively employed when the temperature of the catalyst of the catalytic converter is below the allowable limit during deceleration of the engine.

What is claimed is:

1. A deceleration control system in combination with an internal combustion engine including an intake passageway providing communication between the atmosphere and the engine, a throttle valve rotatably mounted in the intake passageway, and a catalytic converter having a catalyst for oxidizing a burnable component contained in exhaust gases of the engine, said deceleration control system comprising vacuum control means for effecting supply of additional air into the intake passageway downstream of the throttle valve during deceleration of the engine, said vacuum control means having a first position effecting said supply of additional air and a second position stopping said supply of additional air, operating means for moving said vacuum control means into said first position in response to deceleration of the engine and for moving said vacuum control means into said second position in response to operations of the engine other than deceleration, cancel means for causing said operating means to move said vacuum control means into said second position when the temperature of the catalyst is below a predetermined temperature during deceleration of the engine, sensing means for sensing the temperature of the catalyst for generating an output signal representative of the sensed temperature, a modulator electrically connected to said sensing means for comparing the value of said output signal with a reference value representative of said predetermined temperature for generating a command signal when said output signal represents a temperature of the catalyst below said predetermined temperature during deceleration of the engine, and solenoid means operatively connected to said cancel means and having a solenoid electrically connected to said modulator for moving, in response to said command signal during deceleration of the engine, said cancel means into a position causing said operating means to move said vacuum control means into said second position.

2. A deceleration control system as claimed in claim 1, in which said solenoid is so designed as to be energized in response to said command signal during deceleration of the engine.

3. A deceleration control system in combination with an internal combustion engine including an intake passageway providing communication between the atmosphere and the engine, a throttle valve rotatably mounted in the intake passageway, and a catalytic converter having a catalyst for oxidizing a burnable component contained in exhaust gases of the engine, said deceleration control system comprising vacuum control means for effecting supply of additional air into the intake passageway downstream of the throttle valve during deceleration of the engine, said vacuum control means having a first position effecting said supply of additional air and a second position stopping said supply of additional air, pressure responsive means operatively connected to said vacuum control means for moving same into said first position in response to a vacuum in the intake passageway at a location downstream of the throttle valve which is above a predetermined value during deceleration of the engine and for moving said vacuum control means into said second position in response to a vacuum in the intake passageway at said location which is below said predetermined value during operations of the engine other than deceleration, valve means for effecting application of a pressure to said pressure responsive means for causing same to move said vacuum control means into said second position, signal generating means for generating an electric output signal in response to temperatures of the catalyst which are below a predetermined level during deceleration of the engine, and solenoid means operatively connected to said valve means and having a solenoid electrically connected to said signal generating means for moving, in response to said output signal of said signal generating means during deceleration of the engine, said valve means into a position effecting said application of said pressure.

4. A deceleration control system as claimed in claim 3, in which said solenoid is so designed as to be energized in response to said output signal of said signal generating means during deceleration of the engine.

5. A deceleration control system as claimed in claim 1, in which the engine further includes a carburetor having a float chamber, said vacuum control means comprises;

an additional passageway providing communication between the intake passageway downstream of the throttle valve and the atmosphere and communicating with said float chamber;

a vacuum control valve located movable relative to said additional passageway and normally closing said additional passageway said operating means comprising:

a flexible diaphragm having on a side thereof;

a fluid chamber communicating with the intake passageway downstream of the throttle valve;

said diaphragm being so operatively connected to said vacuum control valve as to move, in response to a vacuum in said fluid chamber which is increased during deceleration of the engine, said vacuum control valve into a position in which said vacuum control valve open said additional passageway, and said cancel means comprises:

passage means providing communication between said fluid chamber and the atmosphere, a second control valve for opening and closing said passage means, said solenoid means being operatively connected to said second control valve for causing said solenoid to, in response to said command signal, move said second control valve, into a position in which said second control valve opens said passage means and, for normally moving said second control valve into a position in which said second control valve closes said passage means.

6. A deceleration control system as claimed in claim 5, in which said vacuum control means further comprises a second flexible diaphragm having on a side thereof a second fluid chamber communicating with the first-mentioned fluid chamber, passage means providing communication between said second fluid chamber and the intake passageway downstream of the throttle valve, and a third control valve normally obstructing communication between said first-mentioned fluid chamber and said second fluid chamber, said second diaphragm being so operatively connected to said third control valve as to move, in response to a vacuum in said second fluid chamber which is increased during deceleration of the engine, said third control valve into a position in which said third control valve provides said communication.

7. A deceleration control system as claimed in claim 1, in which said vacuum control device comprises:

a flexible diaphragm having on a side thereof a fluid chamber communicating with the intake passageway downstream of the throttle valve;

said diaphragm being so operatively connected to the throttle valve as to open, in response to a vacuum in said fluid chamber which is increased during deceleration of the engine, the throttle valve a predetermined amount, and said cancel means includes passage means providing communication between said fluid chamber and the atmosphere;

a control valve for opening and closing said passage means, said solenoid means operatively connected to said control valve for causing said solenoid to move, in response to said command signal, into a position in which said control valve opens said passage means and, for normally moving said control valve into a position in which said control valve closes said passage means.

8. A deceleration control system as claimed in claim 7, in which said vacuum control means further comprises a second flexible diaphragm having on a side thereof a second fluid chamber communicating with the first-mentioned fluid chamber, passage means providing communication between said second fluid chamber and the intake passageway downstream of the throttle valve, and a second control valve normally obstructing communication between said first-mentioned fluid chamber and said second fluid chamber, said second flexible diaphragm being so operatively connected to said second control valve as to move, in response to a vacuum in said second fluid chamber which is increased during deceleration of the engine, said second control valve into a position in which said second control valve provides said communication.

* * * * *